US009325054B2

(12) United States Patent
Lin

(10) Patent No.: US 9,325,054 B2
(45) Date of Patent: Apr. 26, 2016

(54) POWER SUPPLY CIRCUIT FOR ANTENNA, ANTENNA CONTROL SYSTEM, AND DIGITAL COMMUNICATION DEVICE

(71) Applicant: Novatek Microelectronics Corp., Hsinchu (TW)

(72) Inventor: Jia-Tzung Lin, Taichung (TW)

(73) Assignee: Novatek Microelectronics Corp., Hsinchu (TW)

( * ) Notice: Subject to any disclaimer, the term of this patent is extended or adjusted under 35 U.S.C. 154(b) by 704 days.

(21) Appl. No.: 13/647,403

(22) Filed: Oct. 9, 2012

(65) Prior Publication Data

US 2013/0134801 A1 May 30, 2013

Related U.S. Application Data

(60) Provisional application No. 61/564,871, filed on Nov. 30, 2011.

(30) Foreign Application Priority Data

Jun. 5, 2012 (TW) ..... 101120154 A

(51) Int. Cl.
*H01Q 1/50* (2006.01)
*H01Q 1/00* (2006.01)

(52) U.S. Cl.
CPC ..... *H01Q 1/002* (2013.01); *H01Q 1/50* (2013.01); *Y10T 307/832* (2015.04)

(58) Field of Classification Search
None
See application file for complete search history.

(56) References Cited

U.S. PATENT DOCUMENTS

| | | | | |
|---|---|---|---|---|
| 4,761,705 | A * | 8/1988 | Reeves et al. | 361/94 |
| 6,249,415 | B1 | 6/2001 | Daoud et al. | |
| 7,486,936 | B2 | 2/2009 | Kappes et al. | |
| 8,218,279 | B2 * | 7/2012 | Liao | G06F 1/266 361/93.1 |
| 2002/0066793 | A1 | 6/2002 | Hayashi | |

(Continued)

FOREIGN PATENT DOCUMENTS

| | | |
|---|---|---|
| CN | 2626107 | 7/2004 |
| CN | 200944578 | 9/2007 |

(Continued)

OTHER PUBLICATIONS

"Office Action of Taiwan Counterpart Application," issued on Feb. 3, 2015, p. 1-p. 7.
"Office Action of China Counterpart Application", issued on May 29, 2015, p. 1-p. 5.

*Primary Examiner* — Jared Fureman
*Assistant Examiner* — Terrence Willoughby
(74) *Attorney, Agent, or Firm* — Jianq Chyun IP Office

(57) ABSTRACT

A power supply circuit, an antenna control system, and a digital communication device are provided. The power supply circuit is adapted to supply electronic power to an antenna and includes a power management circuit and a pin. The power management circuit is coupled between a power input terminal and a power output terminal. In a first mode, the pin receives a mode control signal to control the power management circuit to deliver or not deliver electronic power of a power source from the power input terminal to the power output terminal. In a second mode, the pin stops receiving the mode control signal and provides a detection signal, which indicates whether the power supply circuit is overloaded. Thereby, power switching of the antenna and an overload detection/notification function are accomplished by using the single pin.

22 Claims, 4 Drawing Sheets

(56) References Cited

U.S. PATENT DOCUMENTS

| | | | | |
|---|---|---|---|---|
| 2006/0028779 | A1* | 2/2006 | Bax | H01H 83/226 361/93.1 |
| 2006/0226131 | A1* | 10/2006 | Stava | B23K 9/093 219/130.33 |
| 2011/0032038 | A1 | 2/2011 | Shimamoto et al. | |

FOREIGN PATENT DOCUMENTS

| | | |
|---|---|---|
| CN | 201294372 | 8/2009 |
| CN | 102097814 | 6/2011 |
| TW | 533633 | 5/2003 |
| TW | M412397 | 9/2011 |
| TW | I352474 | 11/2011 |

* cited by examiner

POWER SUPPLY CIRCUIT FOR ANTENNA, ANTENNA CONTROL SYSTEM, AND DIGITAL COMMUNICATION DEVICE

CROSS-REFERENCE TO RELATED APPLICATION

This application claims the priority benefits of U.S. provisional application Ser. No. 61/564,871, filed on Nov. 30, 2011 and Taiwan application serial no. 101120154, filed on Jun. 5, 2012. The entirety of each of the above-mentioned patent applications is hereby incorporated by reference herein and made a part of this specification.

BACKGROUND OF THE INVENTION

1. Field of the Invention

The invention generally relates to a power supply circuit for an antenna, an antenna control system, and a digital communication device, and more particularly, to a power supply circuit in which the power switching of an antenna and an overload detection/notification function are realized by using a single pin, an antenna control system, and a digital communication device.

2. Description of Related Art

Antennas have been broadly applied in our daily life along with the development of communication technology. In order to allow an antenna to operate properly, a power supply circuit is usually disposed to supply electric power to the antenna. A power supply circuit for an antenna includes a power switch circuit and a protection circuit. The power switch circuit controls a power source to supply electric power to the antenna. The protection circuit cuts off the power supply to the antenna when the power supply circuit is overloaded, so as to protect related circuits from being damaged. However, such a power supply circuit does not come with any overload detection/notification function that can detect an overload and issue a detection signal for notifying a user when the power supply circuit is overloaded. Even though some power supply circuits come with the overload detection/notification function, at least two pins are required in such a power supply circuit. One of the pins is used for supplying electric power from the power source to the antenna, and the other pin is used for transmitting an overload detection signal to notify the user when an overload occurs.

SUMMARY

A power supply circuit and an antenna control system and a digital communication device using the same are disclosed, in which the power switching of an antenna and an overload detection/notification function can be realized by using a single pin.

In an aspect, a power supply circuit adapted to supply electric power to an antenna is disclosed. The power supply circuit includes a power management circuit and a pin. The power management circuit is coupled between a power input terminal and a power output terminal. The pin is coupled to the power management circuit. In a first mode, the pin receives a mode control signal to control the power management circuit to deliver or not deliver electric power of a power source from the power input terminal to the power output terminal. In a second mode, the pin stops receiving the mode control signal and provides a detection signal. Herein the detection signal indicates whether an overload occurs.

In another aspect, a power supply circuit including a pin, a positive feedback protection circuit, and a switch is disclosed.

The positive feedback protection circuit is coupled to a power source. The switch is coupled between the positive feedback protection circuit and an antenna. When the switch is turned on, electric power of the power source is supplied to the antenna through the positive feedback protection circuit and the switch. In a first mode, the positive feedback protection circuit maintains the trigger level of a mode control signal received by the pin and controls the on/off state of the switch according to the trigger level. In a second mode, the positive feedback protection circuit detects a current passing through the switch, and when the current is overloaded, the positive feedback protection circuit turns off the switch and changes the level of the pin.

In further another aspect, an antenna control system including the power supply circuit described above and an antenna control circuit is disclosed. The antenna control circuit provides the mode control signal to the pin and receives the detection signal from the pin.

In still further another aspect, a digital communication device including the antenna control system described above, a power source, and an antenna is disclosed. The power source supplies electric power to the power input terminal of the power supply circuit. The antenna receives the electric power from the power input terminal of the power supply circuit.

According to an embodiment of the invention, the positive feedback protection circuit includes a protection circuit and a positive feedback circuit. The protection circuit is coupled between the power source and the switch. The positive feedback circuit is coupled between the protection circuit, the pin, and the switch. In the first mode, the positive feedback circuit controls the on/off state of the switch according to the voltage level of the mode control signal received by the pin. In the second mode, the protection circuit detects whether any overload occurs according to the current and changes the level of the detection signal when an overload occurs.

According to an embodiment of the invention, the positive feedback protection circuit includes a PNP bipolar junction transistor (BJT), an NPN BJT, a first resistor, a second resistor, a third resistor, a fourth resistor, and a fifth resistor. The emitter of the PNP BJT is coupled to the power input terminal and the first end of the first resistor, the base of the PNP BJT is coupled to the first end of the second resistor, and the collector of the PNP BJT is coupled to the switch and the first end of the fourth resistor. The collector of the NPN BJT is coupled to the second end of the second resistor and the second end of the third resistor, the base of the NPN BJT is coupled to the second end of the fifth resistor, and the emitter of the NPN BJT is coupled to the ground. The second end of the first resistor and the first end of the third resistor are coupled to the switch, and the second end of the fourth resistor and the first end of the fifth resistor are coupled to the pin.

According to an embodiment of the invention, the positive feedback circuit including an operational amplifier and a resistor. The positive input terminal of the operational amplifier is coupled to the pin and the protection circuit, the negative input terminal of the operational amplifier is coupled to the ground, and the output terminal of the operational amplifier is coupled to the switch. The resistor is coupled between the positive input terminal and the output terminal of the operational amplifier.

According to an embodiment of the invention, the protection circuit includes a first PNP BJT, a first resistor, and a second resistor. The positive feedback circuit includes a second PNP BJT, a third resistor, a fourth resistor, a fifth resistor, a sixth resistor, and an NPN BJT. The emitter of the first PNP BJT is coupled to the power input terminal and the first end of the first resistor, the base of the first PNP BJT is coupled to the first end of the second resistor, and the collector of the first PNP BJT is coupled to the switch. The second end of the first resistor is coupled to the switch and the second end of the second resistor. The emitter of the second PNP BJT is coupled to the first end of the fourth resistor and the switch, the base of the second PNP BJT is coupled to the first end of the third resistor, and the collector of the second PNP BJT is coupled to the collector of the first PNP BJT, the first end of the fifth resistor, and the switch. The collector of the NPN BJT is coupled to the second end of the third resistor and the second end of the fourth resistor, the base of the NPN BJT is coupled to the second end of the sixth resistor, and the emitter of the NPN BJT is coupled to the ground. The second end of the fifth resistor and the first end of the sixth resistor are coupled to the pin.

According to an embodiment of the invention, the positive feedback protection circuit includes a regulation circuit. The regulation circuit regulates the drop of a voltage received by the antenna when an overload occurs.

According to an embodiment of the invention, in the second mode, when no overload occurs, the power management circuit controls the pin through a positive feedback mechanism to maintain the trigger level of the mode control signal received in the first mode.

According to an embodiment of the invention, in the second mode, when an overload occurs, the power management circuit stops delivering the electric power of the power source to the power output terminal.

According to an embodiment of the invention, the power management circuit includes a switch and a positive feedback protection circuit. The switch is coupled to the power output terminal. The positive feedback protection circuit is coupled among the pin, the switch, and the power input terminal. In the first mode, the positive feedback protection circuit turns the switch on or off according to a voltage level of the mode control signal received by the pin. In the second mode, the positive feedback protection circuit detects whether an overload occurs according to a current from the power source and changes the level of the detection signal when the overload occurs.

According to an embodiment of the invention, the digital communication device is a set-top box or a digital TV.

As described above, according to the disclosure, in the first mode, the power supply circuit can receive a mode control signal through the pin to control the power management circuit to deliver or not deliver the electric power of the power source from the power input terminal to the power output terminal. After that, the power supply circuit can switch from the first mode to the second mode. In the second mode, the power supply circuit can detect whether an overload occurs and stops receiving the mode control signal through the pin. Thereby, the power supply circuit can accomplish the power switching of an antenna and the overload detection/notification function by using a single pin.

These and other exemplary embodiments, features, aspects, and advantages of the invention will be described and become more apparent from the detailed description of exemplary embodiments when read in conjunction with accompanying drawings.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
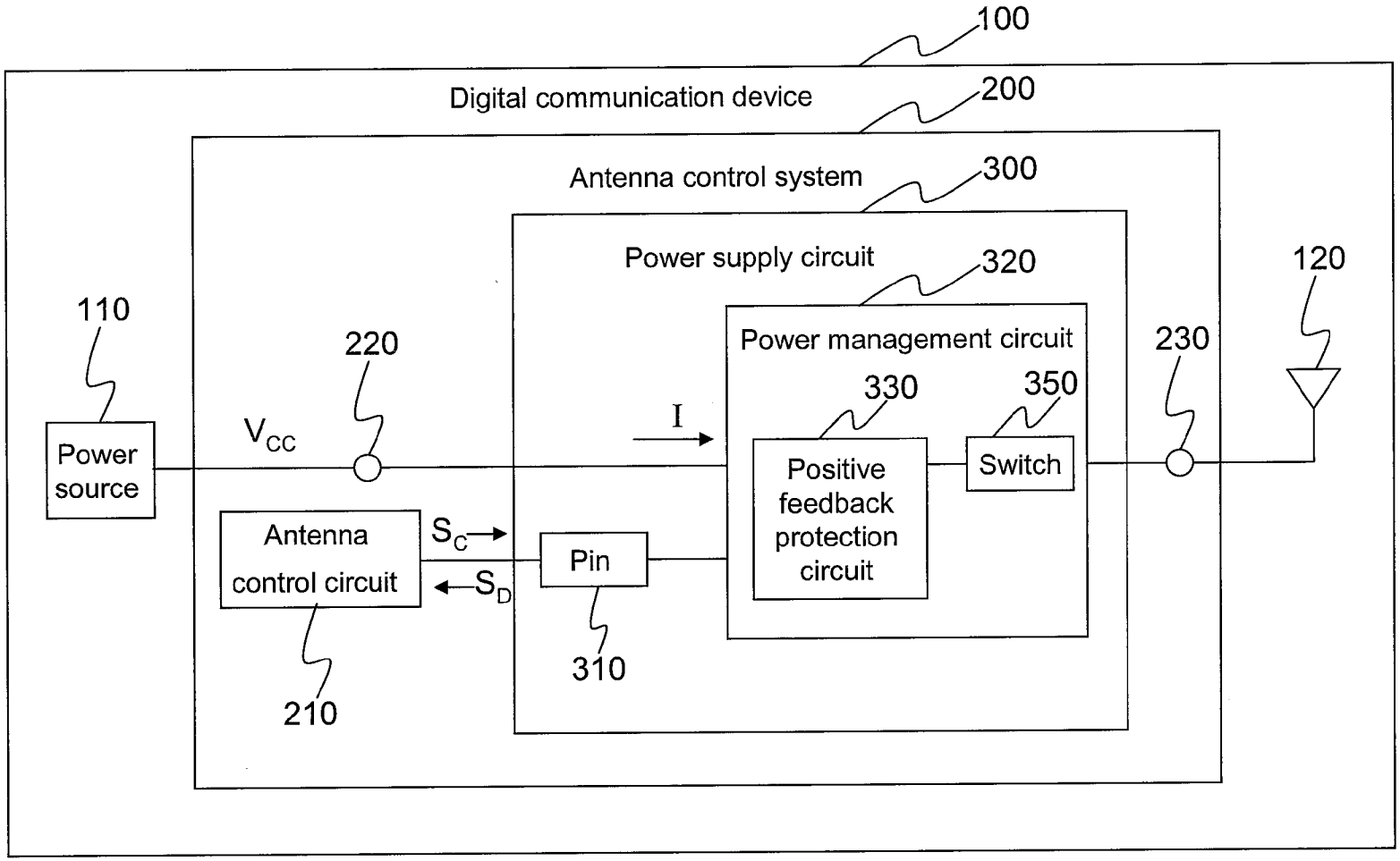
FIG. 1 is a functional block diagram of a digital communication device according to an embodiment of the invention.

Reference will now be made in detail to the present preferred embodiments of the invention, examples of which are illustrated in the accompanying drawings. Wherever possible, the same reference numbers are used in the drawings and the description to refer to the same or like parts. The word "coupled" herein means a direct connection or an indirect connection.

FIG. 1 is a functional block diagram of a digital communication device 100 according to an embodiment of the invention. Referring to FIG. 1, the digital communication device 100 includes a power source 110, an antenna 120, and an antenna control system 200. The power source 110 supplies electric power to the antenna 120 so that the antenna 120 can generate electric waves. Herein the output voltage of the power source 110 is indicated with $V_{CC}$, and the output current of the power source 110 is indicated with I. The antenna control system 200 controls the operation of the antenna 120. It has to be understood that the digital communication device 100 can be but not limited to a mobile phone, a notebook computer, a set-top box, or a digital TV.

In an embodiment of the invention, the antenna control system 200 includes an antenna control circuit 210 and a power supply circuit 300. The power supply circuit 300 supplies the electric power of the power source 110 to the antenna 120. The antenna control circuit 210, which is coupled to the power supply circuit 300, provides a mode control signal $S_C$ to a pin 310 of the power supply circuit 300 and receives a detection signal $S_D$ from the pin 310.

In an embodiment of the invention, the power supply circuit 300 includes the pin 310 and a power management circuit 320. The pin 310 is coupled to the power management circuit 320. The power management circuit 320 is coupled between a power input terminal 220 and a power output terminal 230. The power input terminal 220 is coupled to the power source 110 for receiving the electric power supplied by the power source 110. The power output terminal 230 supplies the electric power from the power source 110 and the power input terminal 220 to the antenna 120.

When the power supply circuit 300 starts to operate, it first enters a first mode and then switches from the first mode to a second mode. When the power supply circuit 300 is in the first mode, the pin 310 receives the mode control signal $S_C$ to control the power management circuit 320 to deliver or not deliver the electric power of the power source 110 from the power input terminal 220 to the power output terminal 230. When the power supply circuit 300 is in the second mode, the pin 310 stops receiving the mode control signal $S_C$ and detects whether an overload occurs, so as to provide the detection signal $S_D$. Herein the detection signal $S_D$ indicates whether an overload occurs. In an embodiment of the invention, the output current I of the power source 110 is greater than a current threshold when an overload occurs. In this case, the power management circuit 320 stops delivering the electric power of the power source 110 to the power output terminal 230. Additionally, it has to be understood that aforementioned current threshold can be flexibly set according to different safety regulations and hardware specifications to meet different requirements.

As described above, the power supply circuit 300 first operates in the first mode and then switches to the second mode. In the first mode, the power management circuit 320 determines whether to supply the electric power of the power source 110 to the antenna 120 according to the mode control signal $S_C$. In the second mode, the power management circuit 320 detects whether an overload occurs and generates the detection signal $S_D$. Herein the mode control signal $S_C$ is input to the power management circuit 320 and the detection signal $S_D$ is output from the power management circuit 320 by using the same pin 310. Thus, the power supply circuit 300 can accomplish the power switching of the antenna 120 and an overload detection/notification function by using the single pin 310.

In an embodiment of the invention, when no overload occurs in the second mode, the power management circuit 320 further controls the pin 310 through a positive feedback mechanism to maintain a trigger level of the mode control signal $S_C$ received in the first mode. For example, if the trigger level of the mode control signal $S_C$ received by the power management circuit 320 in the first mode is a high level, when no overload occurs, the level of the pin 310 in the second mode is also a high level. If the trigger level of the mode control signal $S_C$ received by the power management circuit 320 in the first mode is a low level, when no overload occurs, the level of the pin 310 in the second mode is also a low level.

In an embodiment of the invention, the power management circuit 320 includes a switch 350 and a positive feedback protection circuit 330. The switch 350 is coupled to the power output terminal 230. The positive feedback protection circuit 330 is coupled among the pin 310, the switch 350, and the power input terminal 220. In the first mode, the positive feedback protection circuit 330 controls the on and off of the switch 350 according to the voltage level of the mode control signal $S_C$ received by the pin 310. For example, in an embodiment of the invention, when the voltage level of the mode control signal $S_C$ is a first level, the switch 350 is turned on and the power source 110 is electrically connected with the power output terminal 230 through the switch 350, so that the electric power of the power source 110 can be supplied to the power output terminal 230 and the antenna 120. When the voltage level of the mode control signal $S_C$ is a second level, the switch 350 is turned off so that the electrical connection between the power source 110 and the power output terminal 230 is cut off and accordingly the electric power of the power source 110 cannot be supplied to the power output terminal 230 or the antenna 120. Aforementioned first level and second level are two different levels. Thus, in the first mode, the positive feedback protection circuit 330 maintains the trigger level of the mode control signal $S_C$ received by the pin 310 and controls the on/off state of the switch 350 according to the trigger level.

Additionally, in the second mode, the positive feedback protection circuit 330 detects whether an overload occurs according to the current I from the power source 110 and changes the level of the detection signal $S_D$ when an overload occurs. In other words, when an overload occurs, the output current I of the power source 110 is greater than aforementioned current threshold, and the level of the detection signal $S_D$ is changed to indicate the occurrence of the overload. Herein the power management circuit 320 further turns the switch 350 off to stop delivering the electric power of the power source 110 from the power input terminal 220 to the power output terminal 230. Thus, in the second mode, the positive feedback protection circuit 330 detects the current I from the power source 110, and when the current I is overloaded, turns off the switch 350 and changes of the level of the pin 310 (i.e., changes the level of the detection signal $S_D$).

Additionally, in the second mode, when no overload occurs, the positive feedback protection circuit 330 further controls the pin 310 through a positive feedback mechanism to maintain the trigger level of the mode control signal $S_C$ received in the first mode. For example, if the trigger level of the mode control signal $S_C$ received by the positive feedback protection circuit 330 in the first mode is a high level, when no overload occurs, the level of the pin 310 in the second mode is also a high level. If the trigger level of the mode control signal $S_C$ received by the positive feedback protection circuit 330 in the first mode is a low level, when no overload occurs, the level of the pin 310 in the second mode is also a low level.

Below, an example of the operation flow illustrated in FIG. 1 will be described in detail. When the power source 110 is turned on, the antenna control circuit 210 first sets the pin 310 to the first mode and the level of the pin 310 to a low level and then waits for a specific duration. Accordingly, the power source 110 can supply electric power to the antenna 120. Subsequently, the pin 310 is set to the second mode, and the voltage level of the pin 310 is read and determined whether being a low level. If the voltage level of the pin 310 is a low level, foregoing step is repeated to continuously determine whether the voltage level of the pin 310 is a low level. If the voltage level of the pin 310 is not a low level, an overload is detected. The overload detection function is realized through the procedure described above. Additionally, when the power source is cut off, the pin 310 is set to the first mode and the level thereof is set to a high level. Accordingly, the electric power of the power source 110 cannot be supplied to the antenna 120.

Figure 2:
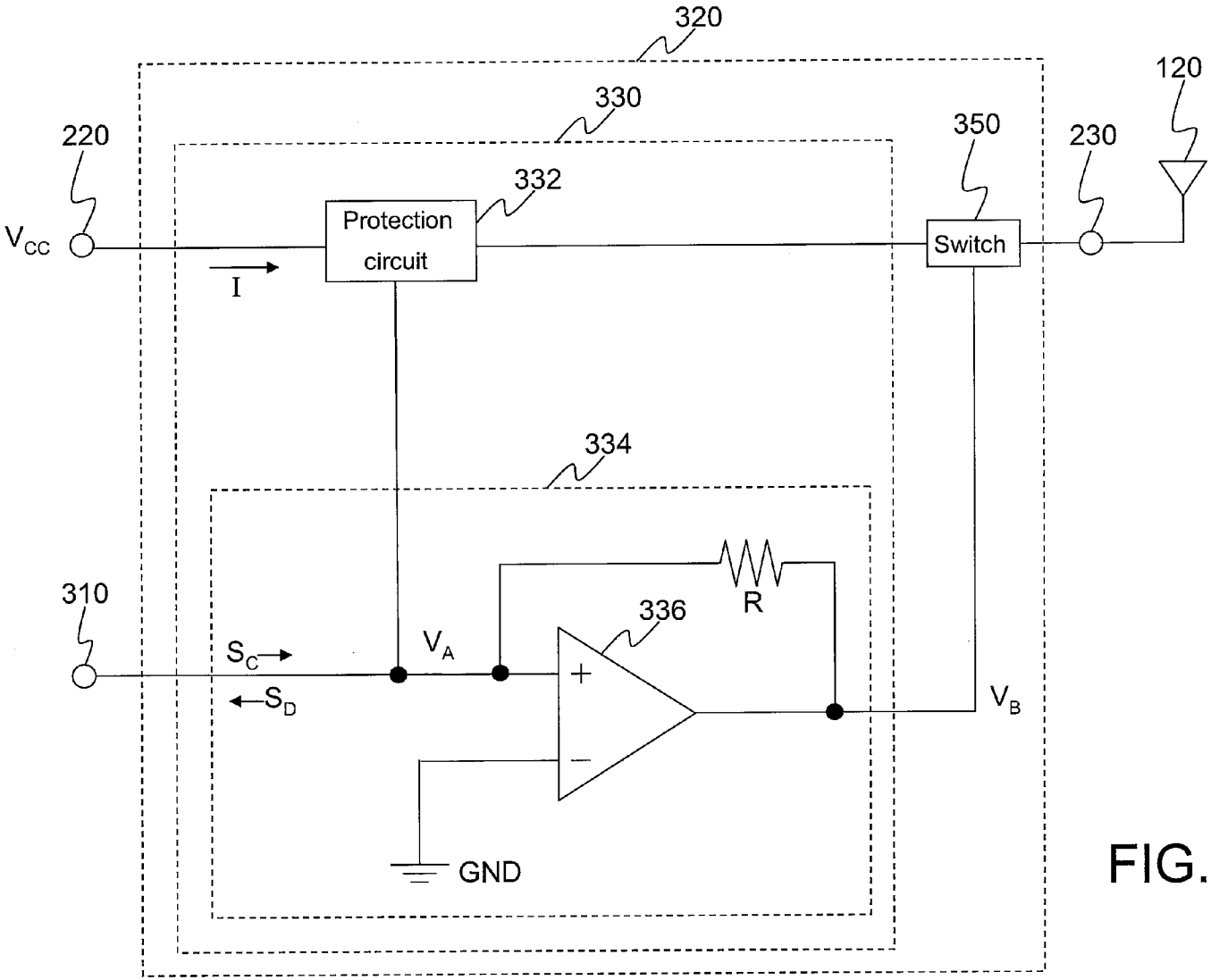
FIG. 2 illustrates the operation of a power management circuit according to an embodiment of the invention.

FIG. 2 illustrates the operation of the power management circuit 320 according to an embodiment of the invention. Referring to FIG. 2, in the present embodiment, the positive feedback protection circuit 330 of the power management circuit 320 includes a protection circuit 332 and a positive feedback circuit 334. The protection circuit 332 is coupled among the power input terminal 220, the switch 350, and the positive feedback circuit 334. The protection circuit 332 detects whether any overload occurs according to the value of the current I, and when an overload occurs, the protection circuit 332 changes a level VA and a level VB of the detection signal $S_D$ and turns off the switch 350 through the positive feedback circuit 334. The positive feedback circuit 334 is coupled among the pin 310, the protection circuit 332, and the switch 350. In the first mode, the positive feedback circuit 334 receives the mode control signal $S_C$ from the pin 310 and accordingly changes the voltage level VA and then the voltage level VB, so as to control the on and off of the switch 350, and the positive feedback circuit 334 can maintain the voltage level VA of the pin 310 through a positive feedback mechanism. Additionally, in the second mode, the positive feedback circuit 334 stops receiving the mode control signal $S_C$ and provides the detection signal $S_D$ to indicate whether any overload occurs. Herein the pin 310 may be in a floating state. If no overload occurs, the positive feedback circuit 334 maintains the voltage levels VA and VB and keeps the switch 350 turned on. If an overload occurs, the overlarge current I affects the operation of the positive feedback circuit 334 through the protection circuit 332. Thus, the voltage level VA is changed to indicate the occurrence of the overload, and the voltage level VB is changed to turn off the switch 350.

In an embodiment of the invention, the positive feedback circuit 334 includes an operational amplifier 336 and a resistor R. The positive input terminal of the operational amplifier 336 is coupled to the pin 310 and the protection circuit 332, the negative input terminal of the operational amplifier 336 is coupled to the ground GND, and the output terminal of the operational amplifier 336 is coupled to the switch 350. The resistor R is coupled between the positive input terminal and the output terminal of the operational amplifier 336.

In the first mode, when the trigger level $V_A$ of the mode control signal $S_C$ is a low level (i.e., the bit value of the mode control signal $S_C$ is 0), the voltage $V_B$ output by the operational amplifier 336 is at a low level, so that the switch 350 is turned on. Herein the electric power of the power source 110 is supplied to the antenna 120 via the power input terminal 220, the protection circuit 332, the switch 350, and the power output terminal 230. In the first mode, when the trigger level $V_A$ of the mode control signal $S_C$ is a high level (i.e., the bit value of the mode control signal $S_C$ is 1), the voltage $V_B$ output by the operational amplifier 336 is at a high level, so that the switch 350 is turned off. Herein the electric power of the power source 110 is not supplied to the antenna 120.

In the second mode, the positive feedback circuit 334 stops receiving the mode control signal $S_C$ and provides the detection signal $S_D$. If no overload occurs in the second mode, the positive feedback mechanism based on the coordination between the positive feedback circuit 334 and the protection circuit 332 allows the pin 310 to maintain the trigger level $V_A$ of the mode control signal $S_C$ received in the first mode. If no overload occurs in the second mode, the level of the pin 310 is maintained at the trigger level $V_A$, and the level of the voltage VB is also maintained, so that the on/off state of the switch 350 in the second mode remains the same as that in the first mode. However, if an overload occurs in the second mode (i.e., the protection circuit 332 detects an overlarge current I), the level VA of the pin 310 (i.e., the level of the detection signal $S_D$) is changed to indicate the occurrence of the overload. Besides, the voltage VB is also changed accordingly to turn off the switch 350.

It should be noted that even though the structure of the positive feedback circuit 334 is described with the operational amplifier 336 and the resistor R in the embodiment illustrated in FIG. 2, in other embodiments, the positive feedback circuit 334 can be implemented with other circuits as long as the voltage level of the pin can be maintained through the positive feedback mechanism and when an overload occurs, the voltage VB can be generated to turn on/off the switch and the voltage VA can be generated to indicate about the occurrence of the overload. More embodiments of the invention will be described below.

Figure 3:
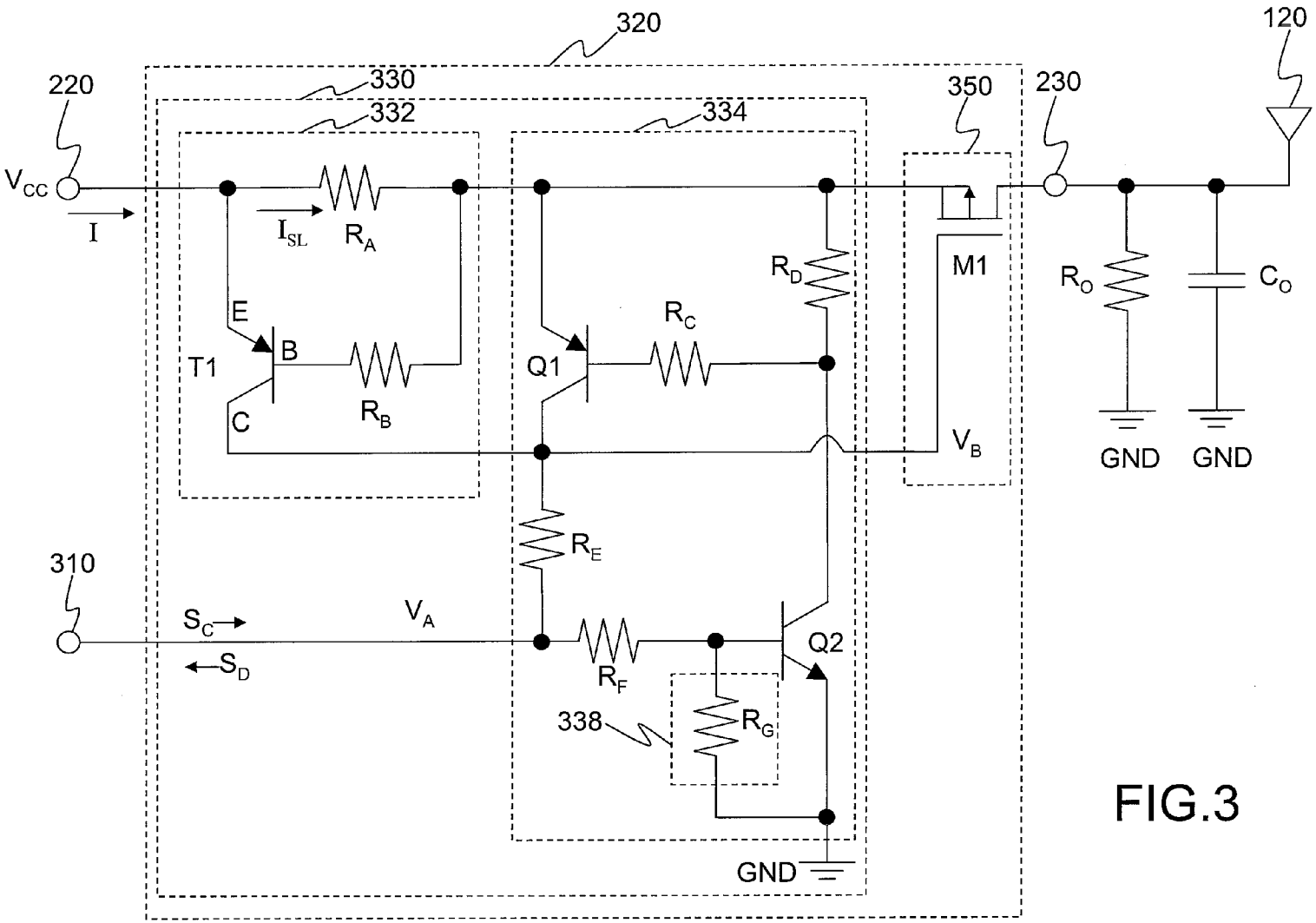
FIG. 3 is a circuit diagram of a power management circuit and an antenna according to an embodiment of the invention.

FIG. 3 is a circuit diagram of a power management circuit 320 and an antenna 120 according to an embodiment of the invention. Referring to FIG. 3, in the present embodiment, the positive feedback protection circuit 330 of the power management circuit 320 also includes a protection circuit 332 and a positive feedback circuit 334.

The protection circuit 332 may include resistors $R_A$ and $R_B$ and a PNP bipolar junction transistor (BJT) T1. The emitter of the PNP BJT T1 is coupled to the power input terminal 220 and the first end of the resistor $R_A$, the base of the PNP BJT T1 is coupled to the first end of the resistor $R_B$, and the collector of the PNP BJT T1 is coupled to the switch 350. The second end of the resistor $R_A$ is coupled to the switch 350 and the second end of the resistor $R_B$. The positive feedback circuit 334 may include a PNP BJT Q1, an NPN BJT Q2, and resistors $R_C$, $R_D$, $R_E$, and $R_F$. Besides, the switch 350 may include a P-type metal-oxide-semiconductor (PMOS) transistor M1. The emitter of the PNP BJT Q1 is coupled to the first end of the resistor $R_D$ and the switch 350, the base of the PNP BJT Q1 is coupled to the first end of the resistor $R_C$, and the collector of the PNP BJT Q1 is coupled to the collector of the PNP BJT T1, the first end of the resistor $R_E$, and the switch 350. The collector of the NPN BJT Q2 is coupled to the second end of the resistor $R_C$ and the second end of the resistor $R_D$, the base of the NPN BJT Q2 is coupled to the second end of the resistor $R_F$, and the emitter of the NPN BJT Q2 is coupled to the ground GND. The second end of the resistor $R_E$ and the first end of the resistor $R_F$ are coupled to the pin 310.

In the first mode, when the trigger level $V_A$ of the mode control signal $S_C$ is a low level, because the PNP BJT Q1 and the NPN BJT Q2 are turned off, the level of the voltage $V_B$ is a low level and the PMOS transistor M1 is turned on. Accordingly, the switch 350 is turned on. Herein the electric power of the power source 110 is supplied to the antenna 120 via the power input terminal 220, the protection circuit 332, the switch 350, and the power output terminal 230. Contrarily, in the first mode, if the trigger level $V_A$ of the mode control signal $S_C$ is a high level, because the PNP BJT Q1 and the NPN BJT Q2 are turned on, the voltage $V_B$ output by the operational amplifier 336 is also at a high level, and the switch 350 is turned off. Herein the electric power of the power source 110 is not supplied to the antenna 120.

In the second mode, the positive feedback circuit 334 stops receiving the mode control signal $S_C$ and provides the detection signal $S_D$. Herein the pin 310 may be in a floating state. If an overload occurs in the second mode, an overlarge current $I_{SL}$ passes through the resistor $R_A$, so that the voltage difference between the emitter E and the base B of the PNP BJT T1 is greater than the cut-in voltage of the PNP BJT T1. Accordingly, the PNP BJT T1 is turned on, and a current passing through the collector of the PNP BJT T1 and the resistor $R_E$ is generated, so that the level of the pin 310 and the level of the voltage $V_B$ are both high levels, the PMOS transistor M1 is turned off, and the switch 350 is turned off.

Moreover, if the trigger level $V_A$ is a low level and no overload occurs in the second mode, since the PMOS transistor M1 is turned on and the transistors Q1, Q2, and T1 are turned off, the level of the pin 310 remains at the trigger level $V_A$ (i.e., a low level) because of the positive feedback effect. Furthermore, if the trigger level $V_A$ is a high level, because the transistors M1 and T1 are turned off and the transistors Q1 and Q2 are turned on, the level of the pin 310 remains at the trigger level $V_A$ (i.e., a high level) in the second mode due to the positive feedback effect.

As described above, in the first mode, the switch 350 is turned on/off according to the level of the voltage received by the pin 310, so that the power supply circuit 300 achieves a power switching function. In the second mode, the level of the pin 310 varies according to whether an overload occurs (if no overload occurs, the level of the pin 310 remains at a low level, and if an overload occurs, the level of the pin 310 changes to a high level), so that the antenna control circuit 210 in FIG. 1 can determine whether an overload occurs according to the level of the pin 310 (i.e., the level of the detection signal $S_D$). Thereby, the power supply circuit 300 achieves an overload detection/notification function.

Figure 4:
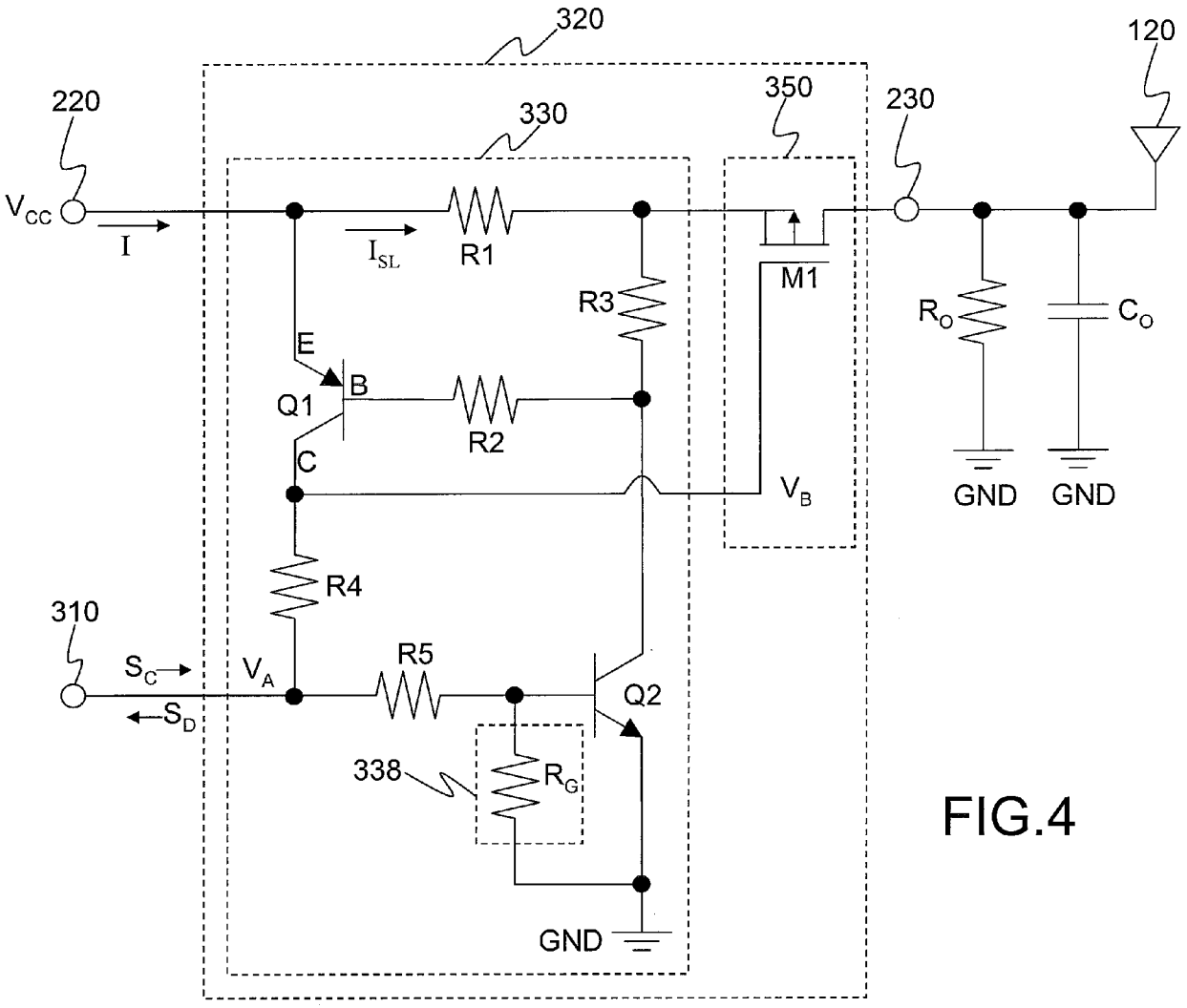
FIG. 4 is a circuit diagram of a power management circuit and an antenna according to an embodiment of the invention.

FIG. 4 is a circuit diagram of a power management circuit 320 and an antenna 120 according to an embodiment of the invention. The major difference between the present embodiment and the embodiment illustrated in FIG. 3 is that the protection circuit 332 and the positive feedback circuit 334 in the positive feedback protection circuit 330 are integrated into one circuit. Referring to FIG. 4, in the present embodiment, the positive feedback protection circuit 330 of the power management circuit 320 includes a PNP BJT Q1, an NPN BJT Q2, and resistors R1-R5. Besides, the switch 350 includes a PMOS transistor M1. Herein the overload protection function of the protection circuit 332 in FIG. 3 is accomplished by the PNP BJT Q1 and the resistors R1-R3 in the present embodiment. In addition, the positive feedback function of the positive feedback circuit 334 in FIG. 3 is accomplished by the PNP BJT Q1, the NPN BJT Q2, and the resistors R1-R5 in the present embodiment.

The emitter of the PNP BJT Q1 is coupled to the power input terminal 220 and the first end of the resistor R1, the base of the PNP BJT Q1 is coupled to the first end of the resistor R2, and the collector of the PNP BJT Q1 is coupled to the switch 350 and the first end of the resistor R4. The collector of the NPN BJT Q2 is coupled to the second end of the resistor R2 and the second end of the resistor R3, the base of the NPN BJT Q2 is coupled to the second end of the resistor R5, and the emitter of the NPN BJT Q2 is coupled to the ground GND. The second end of the resistor R1 is coupled to the first end of the resistor R3 and the switch 350, and the second end of the resistor R2 is coupled to the second end of the resistor R3. The second end of the resistor R4 and the first end of the resistor R5 are coupled to the pin 310.

In the first mode, when the trigger level $V_A$ of the mode control signal $S_C$ is a low level, because the PNP BJT Q1 and the NPN BJT Q2 are turned off, the level of the voltage $V_B$ is a low level, so that the PMOS transistor M1 is turned on, and accordingly the switch 350 is turned on. Herein the electric power of the power source 110 is supplied to the antenna 120. Contrarily, in the first mode, if the trigger level $V_A$ of the mode control signal $S_C$ is a high level, because the PNP BJT Q1 and the NPN BJT Q2 are turned on, the level of the voltage $V_B$ output by the operational amplifier 336 is a high level, so that the switch 350 is turned off. Herein the electric power of the power source 110 is not supplied to the antenna 120.

In the second mode, the positive feedback circuit 334 stops receiving the mode control signal $S_C$ and provides a detection signal $S_D$, and the pin 310 may be in a floating state. Herein if an overload occurs in the second mode, an overlarge current $I_R$, passes through the resistor R1, so that the voltage difference between the emitter E and the base B of the PNP BJT Q1 is greater than the cut-in voltage of the PNP BJT Q1. Accordingly, the PNP BJT Q1 is turned on, and a current passing through the collector C of the PNP BJT Q1 and the resistor R4 is generated, so that the level of the pin 310 and the level of the voltage $V_B$ are both high levels, the PMOS transistor M1 is turned off, and the switch 350 is turned off.

Additionally, if the trigger level $V_A$ is a low level and no overload occurs in the second mode, because the transistor M1 is turned on and the transistors Q1 and Q2 are turned off, the level of the pin 310 remains at the trigger level $V_A$ (i.e., a low level) due to the positive feedback effect. Moreover, if the trigger level $V_A$ is a high level, because the transistor M1 is turned off and the transistors Q1 and Q2 are turned on, the level of the pin 310 remains at the trigger level $V_A$ (i.e., a high level) in the second mode because of the positive feedback effect.

As described above, in the first mode, the switch 350 is turned on/off according to the level of the voltage received by the pin 310, so that the power supply circuit 300 achieves a power switching function. In the second mode, the level of the pin 310 varies according to whether an overload occurs (if no overload occurs, the level of the pin 310 remains at a low level, and if an overload occurs, the level of the pin 310 changes to a high level), so that the antenna control circuit 210 in FIG. 1 can determine whether an overload occurs according to the level of the pin 310 (i.e., the level of the detection signal $S_D$). Thereby, the power supply circuit 300 achieves an overload detection/notification function.

When an overload occurs, the voltage received by the antenna 120 decreases, and the level thereof is lower than that when no overload occurs. In order to control the drop of the voltage received by the antenna 120, in an embodiment of the invention, the positive feedback protection circuit 330 further includes a regulation circuit 338. The regulation circuit 338 is coupled between the base and the emitter of the transistor Q2 and configured to regulate the drop of the voltage received by the antenna 120 when an overload occurs. The regulation circuit 338 includes a resistor $R_G$. Herein the greater the resistance of the resistor $R_G$ is, the less the voltage can drop, while the smaller the resistance of the resistor $R_G$ is, the more the voltage can drop.

In an embodiment of the invention, the power output terminal 230 and the antenna 120 are further coupled with a resistor $R_O$ and a capacitor $C_O$, as shown in FIG. 3 and FIG. 4. The resistor $R_O$ and the capacitor $C_O$ are used to stabilize the voltage output by the power management circuit 320 to the antenna 120, so as to reduce electromagnetic interference (EMI).

As described above, according to embodiments described above, in a first mode, a power supply circuit can receive a mode control signal through a pin, so as to control a power management circuit to deliver or not deliver electric power of a power source from a power input terminal to a power output terminal. After that, the power supply circuit can switch from the first mode to a second mode to start to detect whether an overload occurs and control the pin to stop receiving the mode control signal. Thereby, the power supply circuit can achieve an antenna power switching function and an overload detection/notification function by using a single pin.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A power supply circuit, adapted to supply electric power to an antenna, the power supply circuit comprising:

a power management circuit, coupled between a power input terminal and a power output terminal; and a pin, coupled to the power management circuit, wherein in a first mode, wherein the pin receives a mode control signal and provides the mode control signal to the power management circuit such that the power management circuit determines to deliver or not deliver electric power of a power source from the power input terminal to the power output terminal according to the mode control signal, and in a second mode, the pin stops receiving the mode control signal and provides a detection signal indicating whether an overload occurs.

2. The power supply circuit according to claim 1, wherein in the second mode, when the overload does not occur, the power management circuit controls the pin through a positive feedback mechanism to maintain a trigger level of the mode control signal received in the first mode.

3. The power supply circuit according to claim 1, wherein in the second mode, when the overload occurs, the power management circuit stops supplying electric power of the power source to the power output terminal.

4. The power supply circuit according to claim 1, wherein the power management circuit comprises:

a switch, coupled to the power output terminal; and a positive feedback protection circuit, coupled among the pin, the switch, and the power input terminal, wherein in the first mode, the positive feedback protection circuit turns the switch on or off according to a voltage level of the mode control signal received by the pin, and in the second mode, the positive feedback protection circuit detects whether an overload occurs according to a current from the power source and changes a level of the detection signal when the overload occurs.

5. The power supply circuit according to claim 4, wherein in the second mode, when the overload does not occur, the positive feedback protection circuit controls the pin through a positive feedback mechanism to maintain a trigger level of the mode control signal received in the first mode.

6. The power supply circuit according to claim 4, wherein the positive feedback protection circuit comprises:

a protection circuit, coupled between the power output tenninal and the switch; and a positive feedback circuit, coupled among the protection circuit, the pin, and the switch, wherein in the first mode, the positive feedback circuit turns the switch on or off according to the voltage level of the mode control signal received by the pin, and in the second mode, the protection circuit detects whether the overload occurs according to the current and changes the level of the detection signal when the overload occurs.

7. The power supply circuit according to claim 6, wherein the positive feedback circuit comprises:

an operational amplifier, having a positive input terminal coupled to the pin and the protection circuit, a negative input terminal coupled to a ground, and an output terminal coupled to the switch; and a resistor, coupled between the positive input terminal and the output terminal of the operational amplifier.

8. The power supply circuit according to claim 6, wherein the protection circuit comprises:

a first PNP bipolar junction transistor (BJT);

a first resistor; and a second resistor;

wherein an emitter of the first PNP BJT is coupled to the power input terminal and a first end of the first resistor, a base of the first PNP BJT is coupled to a first end of the second resistor, a collector of the first PNP BJT is coupled to the switch, and a second end of the first resistor is coupled to the switch and a second end of the second resistor;

the positive feedback circuit comprises:

a second PNP BJT;

a third resistor;

a fourth resistor;

a fifth resistor;

a sixth resistor; and an NPN BJT;

wherein an emitter of the second PNP BJT is coupled to a first end of the fourth resistor and the switch, a base of the second PNP BJT is coupled to a first end of the third resistor, and a collector of the second PNP BJT is coupled to the collector of the first PNP BJT, a first end of the fifth resistor, and the switch, wherein a collector of the NPN BJT is coupled to a second end of the third resistor and a second end of the fourth resistor, a base of the NPN BJT is coupled to a second end of the sixth resistor, and an emitter of the NPN BJT is coupled to the ground, wherein a second end of the fifth resistor and a first end of the sixth resistor are coupled to the pin.

9. The power supply circuit according to claim 4, wherein the positive feedback protection circuit comprises:

a PNP BJT;

an NPN BJT;

a first resistor;

a second resistor;

a third resistor;

a fourth resistor; and a fifth resistor, wherein an emitter of the PNP BJT is coupled to the power input terminal and a first end of the first resistor, a base of the PNP BJT is coupled to a first end of the second resistor, and a collector of the PNP BJT is coupled to the switch and a first end of the fourth resistor, wherein a collector of the NPN BJT is coupled to a second end of the second resistor and a second end of the third resistor, a base of the NPN BJT is coupled to a second end of the fifth resistor, and an emitter of the NPN BJT is coupled to a ground, wherein a second end of the first resistor and a first end of the third resistor are coupled to the switch, and a second end of the fourth resistor and a first end of the fifth resistor are coupled to the pin.

10. The power supply circuit according to claim 4, wherein the positive feedback protection circuit comprises:

a regulation circuit, configured to regulate a drop of a voltage received by the antenna when the overload occurs.

11. An antenna control system, comprising:

the power supply circuit according to claim 1; and an antenna control circuit, configured to provide the mode control signal to the pin and receive the detection signal from the pin.

12. A digital communication device, comprising:

the antenna control system according to claim 11;

the power source, configured to supply electric power to the power input terminal of the power supply circuit; and the antenna, configured to receive electric power from the power input terminal of the power supply circuit.

13. The digital communication device according to claim 12, being a set-top box or a digital TV.

14. A power supply circuit, comprising:

a pin;

a positive feedback protection circuit, coupled to a power source; and a switch, coupled between the positive feedback protection circuit and an antenna, wherein when the switch is turned on, electric power of the power source is supplied to the antenna through the positive feedback protection circuit and the switch, wherein in a first mode, the positive feedback protection circuit maintains a trigger level of a mode control signal received by the pin and turns the switch on or off according to the trigger level, wherein in a second mode, the positive feedback protection circuit detects a current from the power source, and when the current is overloaded, the positive feedback protection circuit turns off the switch and changes a level of the pin.

15. The power supply circuit according to claim 14, wherein the positive feedback protection circuit comprises:

a PNP BJT;

an NPN BJT;

a first resistor;

a second resistor;

a third resistor;

a fourth resistor; and a fifth resistor;

wherein an emitter of the PNP BJT is coupled to the power source and a first end of the first resistor, a base of the PNP BJT is coupled to a second end of the second resistor, and a collector of the PNP BJT is coupled to the switch and a first end of the fourth resistor, wherein a collector of the NPN BJT is coupled to the second end of the second resistor and a second end of the third resistor, a base of the NPN BJT is coupled to a second end of the fifth resistor, and an emitter of the NPN BJT is coupled to a ground, wherein a second end of the first resistor and a first end of the third resistor are coupled to the switch, a second end of the fourth resistor and a first end of the fifth resistor are coupled to the pin.

16. The power supply circuit according to claim 14, wherein the positive feedback protection circuit comprises:

a protection circuit, coupled between the power source and the switch; and a positive feedback circuit, coupled among the protection circuit, the pin, and the switch, wherein in the first mode, the positive feedback circuit turns the switch on or off according to a voltage level of the mode control signal received by the pin, and in the second mode, the protection circuit detects whether an overload occurs according to the current and changes a level of the detection signal when the overload occurs.

17. The power supply circuit according to claim 16, wherein the positive feedback circuit comprises:

an operational amplifier, having a positive input terminal coupled to the pin and the protection circuit, a negative input terminal coupled to a ground, and an output terminal coupled to the switch; and a resistor, coupled between the positive input terminal and the output terminal of the operational amplifier.

18. The power supply circuit according to claim 16, wherein the protection circuit comprises:

a first PNP BJT;

a first resistor; and a second resistor;

wherein an emitter of the first PNP BJT is coupled to the power source and a first end of the first resistor, a base of the first PNP BJT coupled to a first end of the second resistor, and a collector of the first PNP BJT is coupled to the switch, and a second end of the first resistor is coupled to the switch and a second end of the second resistor;

the positive feedback circuit comprises:

a second PNP BJT;

a third resistor;

a fourth resistor;

a fifth resistor;

a sixth resistor; and an NPN BJT, wherein an emitter of the second PNP BJT is coupled to a first end of the fourth resistor and the switch, a base of the second PNP BJT is coupled to a first end of the third resistor, and a collector of the second PNP BJT is coupled to the collector of the first PNP BJT, a first end of the fifth resistor, and the switch, wherein a collector of the NPN BJT is coupled to a second end of the third resistor and a second end of the fourth resistor, a base of the NPN BJT is coupled to a second end of the sixth resistor, and an emitter of the NPN BJT is coupled to a ground, wherein a second end of the fifth resistor and a first end of the sixth resistor are coupled to the pin.

19. The power supply circuit according to claim 14, wherein the positive feedback protection circuit comprises:

a regulation circuit, configured to regulate a drop of a voltage received by the antenna when an overload occurs.

20. An antenna control system, comprising:

the power supply circuit according to claim 14; and an antenna control circuit, configured to provide the mode control signal to the pin and receive the detection signal from the pin.

21. A digital communication device, comprising:

the antenna control system according to claim 20;

the power source; and the antenna.

22. The digital communication device according to claim 21, wherein the digital communication device is a set-top box or a digital TV.

* * * * *